US006894587B2

(12) United States Patent
Abe et al.

(10) Patent No.: US 6,894,587 B2
(45) Date of Patent: May 17, 2005

(54) COAXIAL RESONATOR, FILTER, DUPLEXER, AND COMMUNICATION DEVICE

(75) Inventors: Shin Abe, Muko (JP); Seiji Hidaka, Nagaokakyo (JP); Shingo Okajima, Nagaokakyo (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 09/865,146

(22) Filed: May 24, 2001

(65) Prior Publication Data

US 2001/0045875 A1 Nov. 29, 2001

(30) Foreign Application Priority Data

May 25, 2000 (JP) ..... 2000-155381

(51) Int. Cl.[7] ..... H01P 5/12

(52) U.S. Cl. ..... 333/134; 333/206; 333/222; 333/219

(58) Field of Search ..... 333/134, 202, 333/206, 207, 222, 219, 219.1

(56) References Cited

U.S. PATENT DOCUMENTS

| | | | | | |
|---|---|---|---|---|---|
| 2,779,925 | A | * | 1/1957 | Black | 333/222 |
| 3,668,574 | A | * | 6/1972 | Barlow | 333/240 |
| 4,255,729 | A | * | 3/1981 | Fukasawa et al. | 333/202 |
| 4,276,525 | A | * | 6/1981 | Nishikawa et al. | 333/206 |
| 4,318,064 | A | * | 3/1982 | Kach | 333/202 |
| 4,376,920 | A | * | 3/1983 | Smith | 333/12 |
| 5,293,141 | A | * | 3/1994 | Kobayashi et al. | 333/206 |
| 5,539,363 | A | | 7/1996 | Maruyama et al. | |
| 5,898,350 | A | * | 4/1999 | Aberasturi | 333/237 |
| 6,008,707 | A | * | 12/1999 | Tada et al. | 333/134 |
| 6,016,091 | A | * | 1/2000 | Hidaka et al. | 333/202 |
| 6,083,883 | A | * | 7/2000 | Lithgow | 333/219.1 |
| 6,148,221 | A | * | 11/2000 | Ishikawa et al. | 333/202 |
| 6,320,483 | B1 | * | 11/2001 | Raty et al. | 333/207 |
| 6,356,169 | B1 | * | 3/2002 | Toda et al. | 333/134 |
| 6,670,863 | B2 | * | 12/2003 | Van Helvoort et al. | 333/12 |

FOREIGN PATENT DOCUMENTS

| | | | |
|---|---|---|---|
| CN | 12 12478 | | 3/1999 |
| DE | 3906286 | A * | 8/1990 |
| JP | 0003448 | A * | 1/1979 |
| JP | 0143502 | A * | 6/1987 |
| JP | 0258501 | A * | 10/1989 |
| JP | 08167804 | A * | 6/1996 |
| JP | 11-27007 | | 1/1999 |

OTHER PUBLICATIONS

Chinese Office Action dated Mar. 14, 2003.

* cited by examiner

*Primary Examiner*—Robert Pascal
*Assistant Examiner*—Kimberly Glenn
(74) *Attorney, Agent, or Firm*—Dickstein, Shapiro, Morin & Oshinsky, LLP.

(57) ABSTRACT

A coaxial resonator according to an embodiment of the invention includes a tubular dielectric block, an inner conductor having a thin-film, multi-layer electrode structure, which is formed on an outer surface of a cylindrical shaft received in the hole of the tubular dielectric block, and an outer conductor formed on an outer surface of the tubular dielectric block. The cylindrical shaft is inserted into the hole in the dielectric block, and is held by a holding member and an outer frame.

8 Claims, 6 Drawing Sheets

FIG. 6
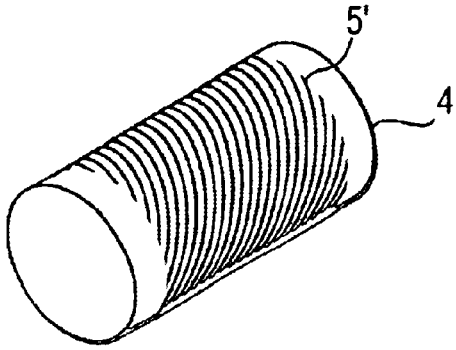
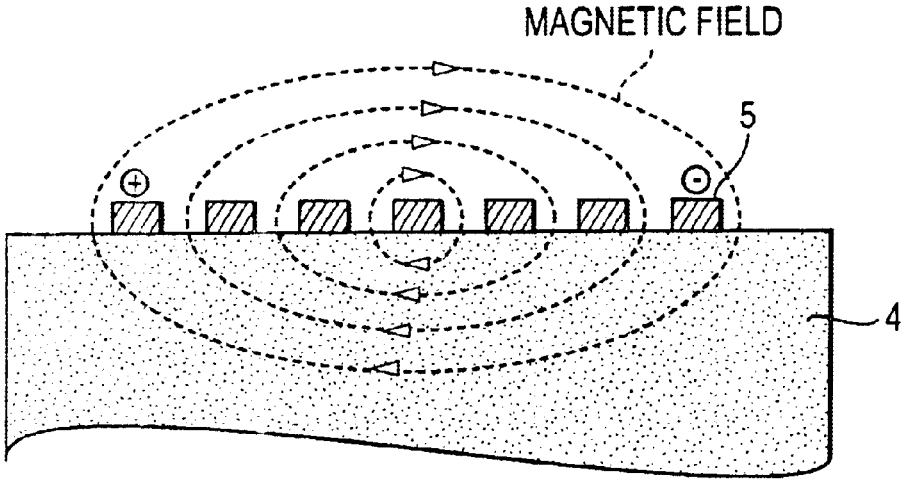
FIG. 7A
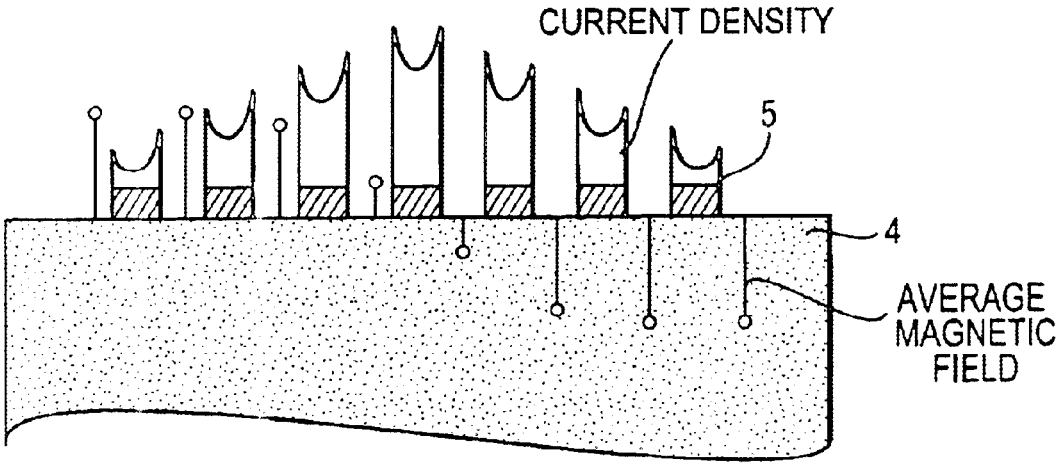
FIG. 7B

COAXIAL RESONATOR, FILTER, DUPLEXER, AND COMMUNICATION DEVICE

BACKGROUND OF THE INVENTION

1. Field of the Invention

The present invention relates to a dielectric resonator, a dielectric filter, and a dielectric duplexer of the type comprising a dielectric block and electrodes formed of conductive films which are formed on internal and/or external surfaces of the dielectric block, and to a communication device using the same.

2. Description of the Related Art

In general, a dielectric resonator for use mainly in the microwave band includes a prism-shaped or cylindrical dielectric block having a through-hole coaxially formed therein, an inner conductor formed on an inner surface of the through-hole, and an outer conductor formed on an outer surface of the dielectric block, so as to operate as a dielectric coaxial resonator. Another form of dielectric resonator includes a rectangular dielectric block having a plurality of through-holes formed therein, an inner conductor formed on an inner surface of each of the through-holes, and an outer conductor formed on an outer surface of the dielectric block, such that a single dielectric block incorporates a plurality of dielectric resonators, so as to operate as a filter or duplexer having multiple stages of resonators.

Such a coaxial resonator, or a filter using the coaxial resonator, is compact as a whole, and is characterized in that the resonator has a high unloaded Q-factor (Qo).

The Qo of the coaxial resonator greatly depends upon the profiles of the inner conductor and the outer conductor, and it is important to form conductor films each having a precise and smooth surface in order to enhance the Qo. Since the coaxial resonator is structured with a conductor film deposited on an inner surface of a hole formed in the dielectric block, it is difficult to improve the characteristics of the inner conductor film, as compared with those of the outer conductor formed on an outer surface of the dielectric block.

For example, in the case of a transmission filter or a duplexer used as a shared antenna device in a circuit which encounters relatively large power, as electronic components to be incorporated in the circuit are made more compact, with reduced power consumption, the demand increases for further reduction of losses caused by the resonator or the filter.

The resonator losses typically include conductor loss caused by the conductor films, dielectric loss in dielectric portions, and radiation loss due to radiation to the outside. Of these losses, the conductor loss accounts for the greatest part of the resonator losses, and therefore, it is of significance how to reduce the conductor loss.

An effective approach to reducing the conductor loss is to use a conductor material having a high electric conductivity and to increase the film thickness. In high-frequency-band devices such as microwave band devices, however, current flow is concentrated only in the skin-depth portion of the conductor film. Hence, making the conductor film thicker than the skin depth provides substantially no advantage with respect to reducing the conductor loss.

An extremely effective approach is described in Japanese Patent Application No. 11-3 14658 (which corresponds to U.S. Pat. Ser. No. 09/707,264 filed Nov., 6, 2000), in which a conductor film has a thin-film, multi-layer electrode structure, in which thin-film conductor layers and thin-film dielectric layers are alternately laminated.

Another extremely effective approach is described in Japanese Patent Application No. 11-375 194 (which corresponds to U.S. Pat. Ser. No. 09/750,947 filed Dec. 28, 2000), in which an inner conductor of a coaxial resonator is formed of plurality of multiplexed helical lines.

However, it is difficult to form either a thin-film, multi-layer electrode or to form a multiplexed inner conductor on an inner surface of a hole having a small inner diameter.

SUMMARY OF THE INVENTION

Accordingly, the present invention provides a coaxial resonator, a filter, and a duplexer, which are compact and which have reduced loss, and a communication device using the same.

The present invention also provides a coaxial resonator, a filter, and a duplexer in which it is easy to form an inner conductor having characteristics beneficial to reduce losses, and a communication device using the same.

In one aspect of the present invention, a coaxial resonator includes an inner conductor formed on an outer surface of a columnar element, a dielectric element having a hole formed therein for receiving the columnar element, and an outer conductor formed on an outer surface of the dielectric element. Since the inner conductor is formed on the outer surface of the columnar element, an inner conductor comprising an improved conductor film which is capable of reducing the conductor loss can be easily formed, and disposed so as to be isolated from the dielectric element.

Preferably, the inner conductor has a thin-film, multi-layer electrode structure in which thin-film conductor layers and thin-film dielectric layers are alternately laminated. This enables current flow to be dispersed among the thin-film conductor layers in the thin-film, multi-layer electrode, thus substantially increasing the current path area (effective cross-sectional area) to reduce the conductor loss. For example, the thin-film conductor layers may be thinner than the skin depth at the frequency that the resonator uses, allowing current to substantially uniformly flow in the thin-film conductor layers, resulting in a coaxial resonator with further reduced losses.

The inner conductor may be a plurality of multiplexed helical lines. If the plurality of helical lines is considered as a single line, macroscopically, therefore, one line neighbors another line, so that the presence of the edges of the lines becomes unclear. Therefore, the current concentration at the edges of each line is moderated to suppress the overall conductor loss.

Preferably, the outer conductor has a thin-film, multi-layer electrode structure in which thin-film conductor layers and thin-film dielectric layers are alternately laminated. This further reduces the conductor loss in the outer conductor.

The phase constants of lines for the thin-film conductor layers are substantially equal between the inner conductor and the outer conductor. This improves a current dispersion effect in the thin-film, multi-layer electrode structure, efficiently reducing the conductor loss.

A non-conducting element may be filled in the space between the columnar element and the dielectric element. This structure maintains a fixed positional relationship between the columnar element and the dielectric element, preventing a change in characteristics due to relative displacement of these two components.

In another aspect of the present invention, a filter includes a plurality of coaxial resonators having any of the foregoing structures, and an input/output unit or device coupled to at least one predetermined coaxial resonator of the plurality of coaxial resonators.

In another aspect of the present invention, a duplexer includes a transmission filter disposed between a transmission signal input port and a transmission/reception signal input/output port, and a reception filter disposed between the transmission/reception signal input/output port and a reception signal output port. Either or both of these filters has the foregoing structure.

In another aspect of the present invention, a communication device includes one or both of the above-described filter and the above-described duplexer as, for example, a band-pass filter for transmission and reception signals, and/or a shared antenna device. This provides a compact and high power efficiency communication device.

Other features and advantages of the present invention will become apparent from the following description of embodiments of the invention which refers to the accompanying drawings.

BRIEF DESCRIPTION OF THE DRAWINGS

FIG. 6 is a cross-sectional view of a coaxial resonator according to a fifth embodiment of the present invention;

FIGS. 7A and 7B are views illustrating the electromagnetic field distribution in the coaxial resonator shown in FIG. 6;

DETAILED DESCRIPTION OF EMBODIMENTS OF THE INVENTION

A coaxial resonator according to a first embodiment of the present invention is described with reference to FIGS. 1A, 1B, and 2.

Figure 1A:
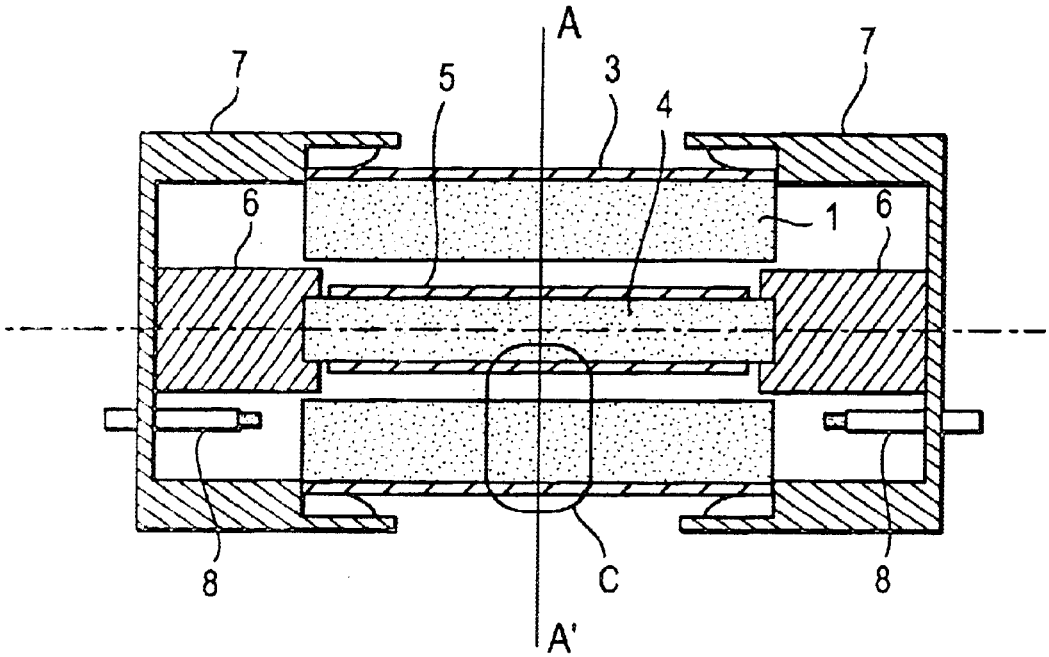
FIG. 1A is a cross-sectional view of a coaxial resonator according to a first embodiment of the present invention.
Figure 1B:
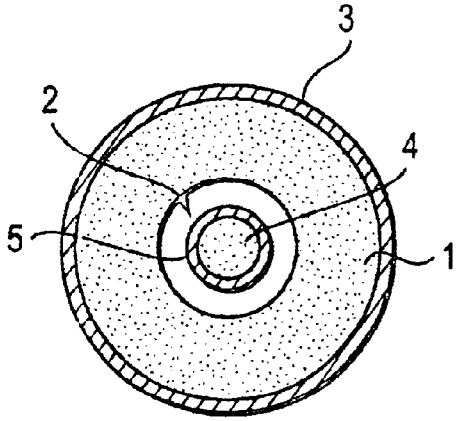
FIG. 1B is a cross-sectional view of the coaxial resonator taken along line A–A' of FIG. 1A.

FIG. 1A is a cross-sectional view of the coaxial resonator taken along the central axis shown by the dot-dash line in the figure, and FIG. 1B is a cross-sectional view of the same coaxial resonator taken along line A–A' of FIG. 1A. The coaxial resonator includes a tubular dielectric block 1, an outer conductor 3 formed on an outer periphery of the dielectric block 1, and an inner conductor 5 formed on a lateral face of a cylinder element 4. The cylinder element 4 is held at its ends by cap-shaped holding members 6 so as to be received within the hole 2 in the dielectric block 1. The coaxial resonator further includes outer frames 7 attached to the ends of the dielectric block 1 for securing the holding members 6. The outer frames 7 include probes 8 which extend toward the cylinder element 4 so as to provide an input/output unit.

Figure 2:
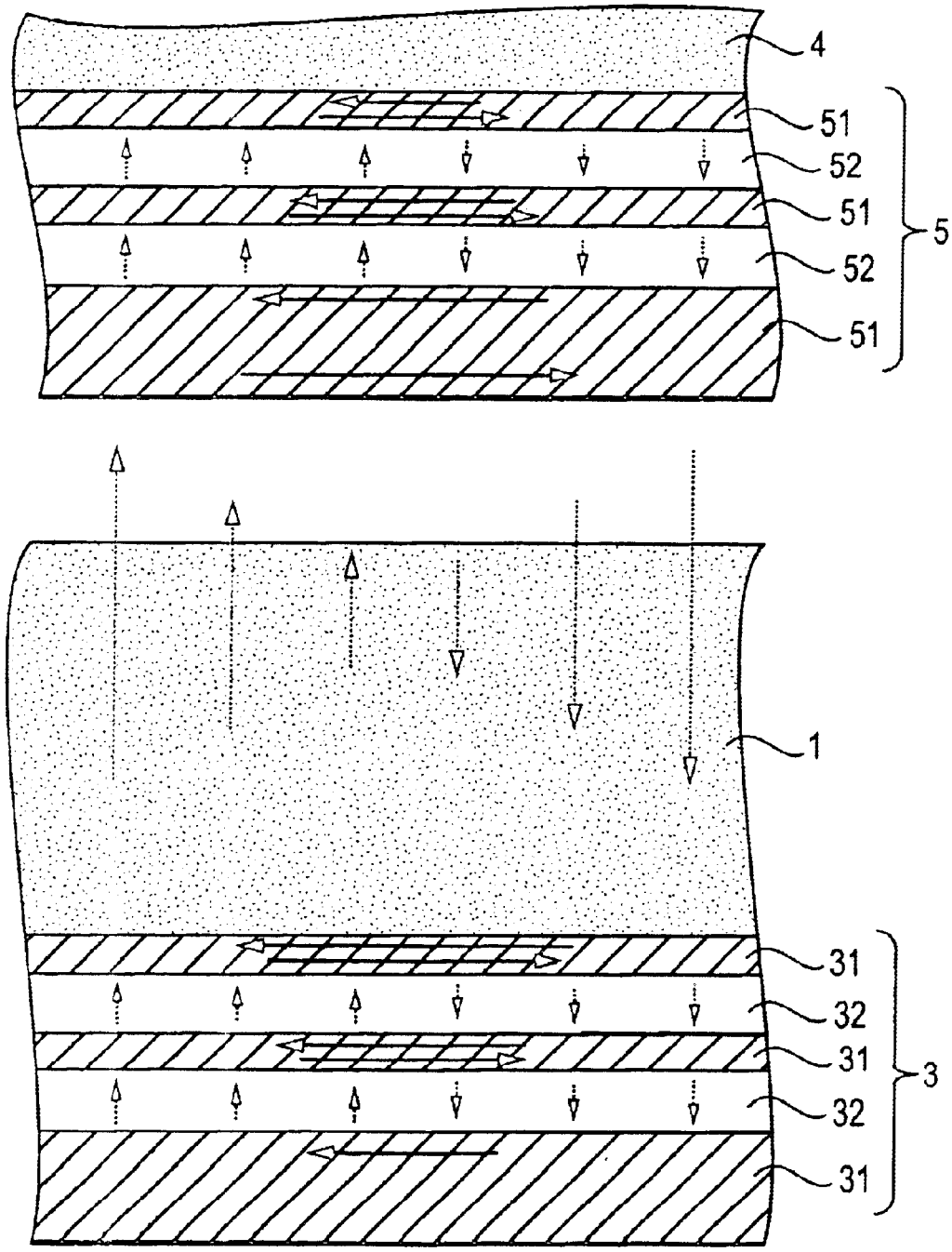
FIG. 2 is an enlarged cross-sectional view of a section of the coaxial resonator shown in FIG. 1A.

FIG. 2 is an enlarged cross-sectional view of a portion of the coaxial resonator indicated by section C of FIG. 1A.

As seen in FIG. 2, the inner conductor 5 has a thin-film, multi-layer electrode structure and is formed by alternately laminating thin-film conductor layers 51, which are thinner than the skin depth, and thin-film dielectric layers 52. Similarly, the outer conductor 3 has a thin-film, multi-layer electrode structure and is formed by alternately laminating thin-film conductor layers 31, which are thinner than the skin depth, and thin-film dielectric layers 32. The outermost layer of the thin-film conductor layers 51 is thicker than the other layers, thus providing a robust surface in the thin-film, multi-layer electrode structure of the inner conductor 5. Similarly, the outermost layer of the thin-film conductor layers 31 is thicker than the other layers, thus providing a robust surface in the thin-film, multi-layer electrode structure of the outer conductor 3. A thin-film dielectric layer may be formed on the bottom layer of the inner conductor 5 as a protective layer of the cylindrical shaft 4, such that when the cylindrical shaft 4 is a metal bar, this thin-film dielectric layer serves as an oxidation-resistant layer on the metal bar.

For clarification of illustration, FIG. 2 emphasizes the a cross-section of the thin-film, multi-layer electrode structure more than the other portions.

The thin-film conductor layers 51 and 31 are each deposited by sputtering Cu, and the thin-film dielectric layers 52 and 32 are each deposited by sputtering $SiO_2$. The thickness of the layers is controlled depending upon the sputtering time. The thin-film, multi-layer electrode structure for each of the inner conductor 5 and the outer conductor 3 is thus formed by alternately sputtering targets to form Cu films and targets to form $SiO_2$ films.

The thin-film, multi-layer electrode structure for the inner conductor 5 is formed by sputtering while the cylindrical shaft 4 is rotated in a deposition container using its central axis as the rotation axis. This provides an annular ring pattern for the thin-film, multi-layer electrode structure. The outer conductor 3 is also formed by sputtering while the dielectric block 1 is rotated in a deposition container using its central axis as the rotation axis.

When a high-frequency signal having a predetermined frequency is applied between the outer conductor 3 and the inner conductor 5 under the condition shown in FIG. 2, a high-frequency electric field is applied to the dielectric block 1 to produce resonance, as indicated in FIG. 2.

A portion of the high-frequency power incident through the lower thin-film dielectric layers 52 (layers closer to dielectric portions of the dielectric block 1) is transmitted through the thin-film conductor layers 51 to the upper thin-film conductor layers 51, and a portion of the energy of the high-frequency signal is reflected to the lower thin-film conductor layers 51 through the lower thin-film dielectric layers 52. Each of the thin-film dielectric layers 52 between two adjacent thin-film conductor layers 51 contains a reflection wave and a transmission wave, which resonate with each other, allowing two opposite high-frequency currents to flow in opposite directions in the vicinity of the upper and lower surfaces of each thin-film conductor layer 51.

A portion of the high-frequency power incident through the lower thin-film dielectric layers 32 (layers closer to dielectric portions of the dielectric block 1) is transmitted through the thin-film conductor layers 31 to the upper thin-film conductor layers 31, and a portion of the energy of the high-frequency signal is reflected to the lower thin-film conductor layers 31 through the lower thin-film dielectric layers 32. Each of the thin-film dielectric layers 32 between two adjacent thin-film conductor layers 31 contains a reflection wave and a transmission wave, which resonate with each other, allowing two opposite high-frequency currents to flow in opposite directions in the vicinity of the upper and lower surfaces of each thin-film conductor layer 31.

That is, since the thin-film conductor layers 31 and 51 are thinner than the skin depth, the two opposite high-frequency currents interfere and cancel with each other, except for some portions, through the thin-film dielectric layers 32 and 52.

The thin-film dielectric layers 32 and 52 suffer from displacement currents due to an electromagnetic field, thus producing high-frequency electric currents on surfaces of the adjacent thin-film conductor layers 31 and 51. Since the first embodiment is implemented as a half-wave coaxial resonator having both ends open, the inner conductor 5 exhibits a maximum displacement current at the ends in its longitudinal direction, and a minimum displacement current at the center.

Assuming that the thickness of the air space defined between the inner conductor 5 and the inner surface of the hole formed in the dielectric block 1 is indicated by h1, having a relative permittivity $\in$r1, and the thickness of the dielectric block 1 is indicated by h2, having a relative permittivity $\in$r2 , then the effective relative permittivity $\in$r of the dielectric element between the inner conductor 5 and the outer conductor 3 is found by $$\in r=(h1+h2)/\{(h1/\in r1)+(h2/\in r2)\}$$

in an equivalent circuit design of a direct-current capacitor.

Provided that h1=0.41 mm, h2=5.0 mm, $\in$r1=1, and $\in$r2=39, then, the effective relative permittivity of the dielectric element is determined to be $\in$r=10.0

Generally, in the film thickness design of the thin-film, multi-layer electrode structure, the substrate portion is considered as a main line, and the dielectric layers in the thin-film, multi-layer electrode as a sub line. The phase constant βm of the main line is expressed by $$\beta m=w\sqrt{(\mu o\in o\in m)} \quad (1)$$

where $\in$m denotes the relative permittivity of the main line, $\in$o and $\mu$o denote the permittivity and the permeability in vacuum, respectively, and ω denotes the angular frequency. The film thickness design is achieved by matching the phase constant βm of the main line with the phase constant βs of the sub line. If the thickness of the top conductor layer is ∞, the thickness $\Delta_\chi$ of the dielectric layer and the thickness Δξ of the conductor layers other than the top layer are expressed by equations as follows, respectively:

$$\Delta_\chi=(Wn\delta o/2)\ (\in m/\in s-1)^{-1} \quad (2)$$

$$\Delta\xi=\xi n\ \delta o \quad (3)$$

where n denotes the number of layers in the thin-film, multi-layer electrode, $\in$s denotes the relative permittivity of the dielectric layer, and δo denotes the skin depth. Wn and ξn denote dimensionless constants which depend upon n, and are determined by calculation using an equivalent circuit. If n=2, then W2=2.00, and ξ2 =0.785.

Considering that the relative permittivity $\in$m of the main line is equivalent to the effective relative permittivity ($\in$r=10.0) of the dielectric element, and given that the resonant frequency f=2 GHz, then the thicknesses Δχ and Δξ are determined as follows from equations (1), (2), and (3):

$$\Delta_\chi=1.03\ \mu m$$

$$\Delta_\chi=1.21\ \mu m$$

Now, the unloaded Q-factor (Qo) of the resonator is simulated under a condition in which the outermost layer of the thin-film conductor layers 51 is 3 $\mu$m thick, the lowest layer of the thin-film dielectric layers 52 is 1 $\mu$m thick, and the outer conductor is formed of a single-layer electrode which is 5 $\mu$m thick. When conductor loss caused by the outer conductor is not considered, Qo would be enhanced by a factor of 1.35 over the case where the inner conductor 5 is formed of a single-layer electrode.

However, since the main line of the present invention contains an air space in practice, the relative permittivity $\in$m is not found directly, unlike a conventional model in which no air space is contained. Thus, the thickness $\Delta_\chi$of the dielectric layer is not derived. For this reason, a finite element method waveguide analysis program is used to determine the phase constant βm of the main line, followed by calculating the thickness $\Delta_\chi$ from equations (1) and (2).

If the same values are given to h1, h2, $\in$r1, and $\in$r2 , and the resonant frequency f=2 GHz is given, then βm and $\in$m are determined as follows:

$$\beta m=151.7$$

$$\in m=13.1$$

Then, the optimum film thicknesses are derived as follows:

$$\Delta_\chi=0.661\ \mu m$$

$$\Delta\xi=1.21\ \mu m$$

Now, the Qo of the resonator is simulated under a condition in which the outermost layer of the thin-film conductor layers 51 is 3 $\mu$m thick, and an outer conductor is formed of a single-layer electrode which is 5 $\mu$m thick. When conductor loss caused by the outer conductor is not considered, the Qo would be enhanced by a factor of 1.52 over the case where the inner conductor 5 is formed of a single-layer electrode.

In this way, by determining the thickness of the thin-film layers so that the phase constants of the lines, each line comprising the thin-film dielectric layer and the adjacent thin-film conductor layers, may be substantially equal, the high-frequency currents which flow in the thin-film conductor layers 31 and 51 have the same phase. Since the current flow is dispersed, the skin depth increases substantially. This substantially increases the current path area (effective cross-sectional area) to reduce the conductor loss. As a result, the Qo is increased further.

Although the inner conductor 5 has a thin-film, multi-layer electrode structure in the first embodiment, the inner conductor 5 may also have a single-layer thin-film electrode structure, formed on an outer surface of a cylindrical shaft by sputtering or vacuum evaporation.

A coaxial resonator according to a second embodiment of the present invention is described with reference to FIGS. 3A and 3B.

Figure 3A:
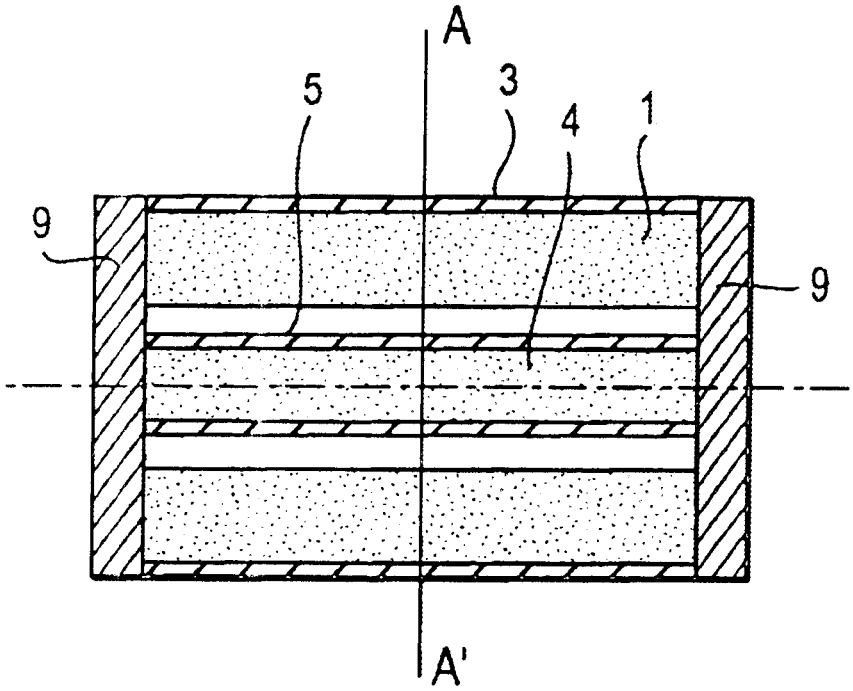
FIG. 3A is a cross-sectional view of a coaxial resonator according to a second embodiment of the present invention.
Figure 3B:
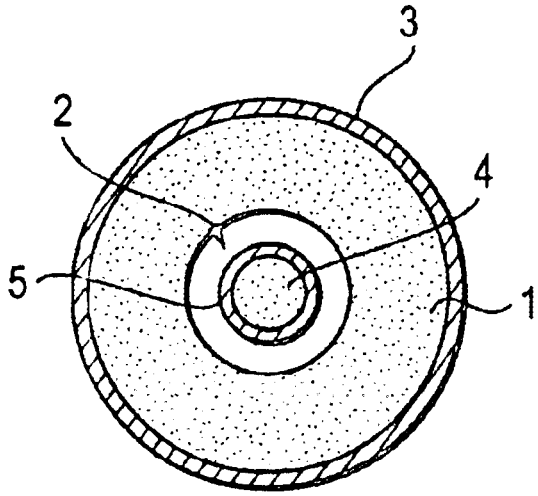
FIG. 3B is a cross-sectional view of the coaxial resonator taken along line A–A' of FIG. 3A.

FIG. 3A is a cross-sectional view of the coaxial resonator taken along the central axis shown by the dot-dash line, and FIG. 3B is a cross-sectional view of the same coaxial resonator taken along line A–A' of FIG. 3A. The coaxial resonator includes a tubular dielectric block 1, an outer conductor 3 formed on an outer periphery of the dielectric block 1, and an inner conductor 5 formed on a lateral face of a cylindrical shaft 4. The cylindrical shaft 4 is held by a short-circuit holding member 9 so as to be received within the hole 2 in the dielectric block 1. The short-circuit holding member 9 also conductively connects the inner conductor 5 formed on the outer surface of the cylindrical shaft 4 and the outer conductor 3 formed on the outer surface of the dielectric block 1. In this way, short-circuiting the ends of the inner conductor 5 allows the coaxial resonator according to the second embodiment to provide half-wave resonance with the ends shorted.

Although no input/output unit is shown in the example shown in FIGS. 3A and 3B, a probe associated with a coaxial resonant mode in an electric field or a loop associated with a coaxial resonant mode in a magnetic field, by way of example, may also be included.

Figure 4A:
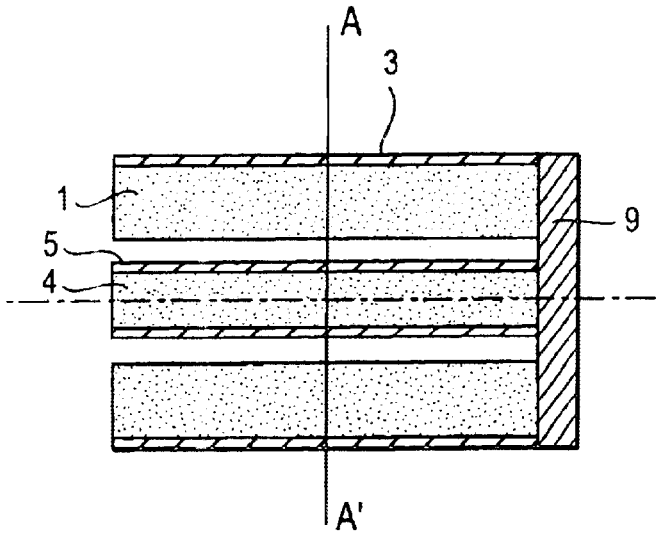
FIG. 4A is a cross-sectional view of a coaxial resonator according to a third embodiment of the present invention.
Figure 4B:
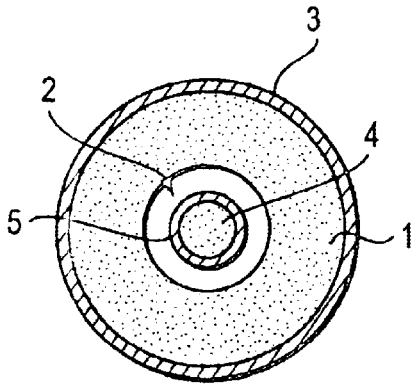
FIG. 4B is a cross-sectional view of the coaxial resonator taken along line A–A' of FIG. 4A.

FIGS. 4A and 4B illustrate a coaxial resonator according to a third embodiment of the present invention. The differences from the coaxial resonator of the second embodiment shown in FIGS. 3A and 3B are that, according to the third embodiment, one end of the cylindrical shaft 4 is held by the short-circuit holding member 9 so as to short the associated end of the inner conductor 5 to the outer conductor 3. This structure allows the coaxial resonator of the third embodiment to provide quarter-wave resonance with one end open and the other end shorted.

Figure 5:
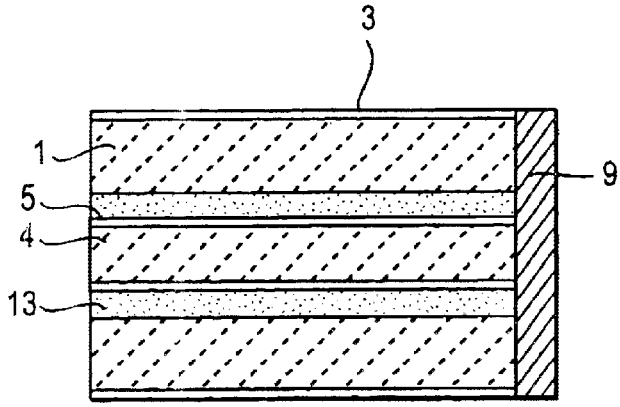
FIG. 5 is a perspective view of a cylindrical shaft incorporated in a coaxial resonator according to a fourth embodiment of the present invention.

FIG. 5 is a cross-sectional view of a coaxial resonator according to a fourth embodiment of the present invention. As is apparent from comparison with that shown in FIGS. 4A and 4B, a non-conducting element 13 made of a material such as resin having low permittivity or high permittivity is filled in a gap between the cylindrical shaft 4 and the dielectric block 1. This structure maintains a fixed positional relationship between the cylindrical shaft 4 and the dielectric block 1, preventing a change in characteristics due to relative displacement of these components.

A coaxial resonator according to a fifth embodiment of the present invention is described with reference to FIGS. 6, 7A, and 7B.

FIG. 6 is a perspective view of a cylindrical shaft 4 incorporating an inner conductor of the coaxial resonator. A plurality of helical lines 5' are arranged, so as to be multiplexed, at a uniform angle on a lateral face of the cylindrical shaft 4 using the central axis of the cylindrical shaft 4 as the rotation center. A group of such helical lines works as an inner conductor. The group of helical lines is hereinafter referred to as "multiple helical line unit." The multiple helical line unit is described in Japanese Patent Application No. 11-375194, as noted above.

FIGS. 7A and 7B are partial cross-sectional views of the multiple helical line unit taken along a plane perpendicular to the lines thereof, showing an example of a distribution of the electromagnetic field and electric current in the helical lines. FIG. 7A illustrates the electric field and magnetic field distribution of the multiple helical line unit at the moment when the charge at the inner and outer circumferential edges of the line unit is maximum. FIG. 7B illustrates the current density of the lines at that moment, and the average magnetic field which extends between the lines in the direction of thickness of the dielectric element.

Microscopically, the current density is higher at the edges of each line, as shown in FIG. 7B. As viewed in the axial direction of the cylindrical shaft 4 (in the horizontal direction of FIG. 7B), however, adjacent the right and left edges of each given helical line, at a predetermined interval therefrom, are formed adjacent helical conductor lines through which electric current having the same amplitude and phase flows as in the given helical line, thereby reducing the edge effect. In other words, the multiple helical line unit can be considered as a single line, in which the distribution of electric current density in the line unit forms substantially a sine curve, in which the inner and outer circumferential edges form nodes and the center forms a peak. Macroscopically, therefore, the edge effect is prevented.

Accordingly, even when the inner conductor is formed as plurality of multiplexed lines, the group of lines may be easily patterned because they are formed on an outer surface of a cylindrical shaft.

Figure 8:
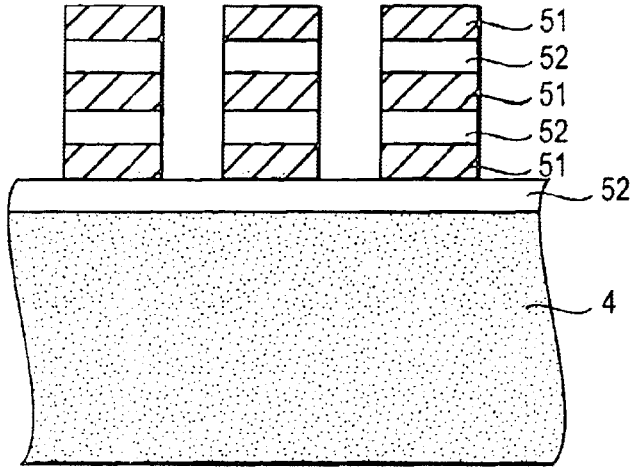
FIG. 8 is an enlarged cross-sectional view of a main portion of a coaxial resonator according to a sixth embodiment of the present invention.

FIG. 8 is an enlarged view of a main portion of a coaxial resonator according to a sixth embodiment of the present invention. The coaxial resonator includes inner conductors formed on an outer surface of the cylindrical shaft 4 so as to have a thin-film, multi-layer electrode structure, and the inner conductors are formed in the same pattern as the multiple helical line unit shown in FIGS. 6, 7A, and 7B. In FIG. 8, thin-film conductor layers 51 and thin-film dielectric layers 52 are alternately laminated to form a thin-film, multi-layer electrode which is divided into a plurality of helical lines for the purpose of multiplexing. In the sixth embodiment, the bottom layer of the thin-film dielectric layers 52, which underlies the inner conductor, serves to cover and protect the outer surface of the cylindrical shaft 4.

The configuration of a duplexer according to a seventh embodiment of the present invention is described with reference to FIG. 9.

Figure 9:
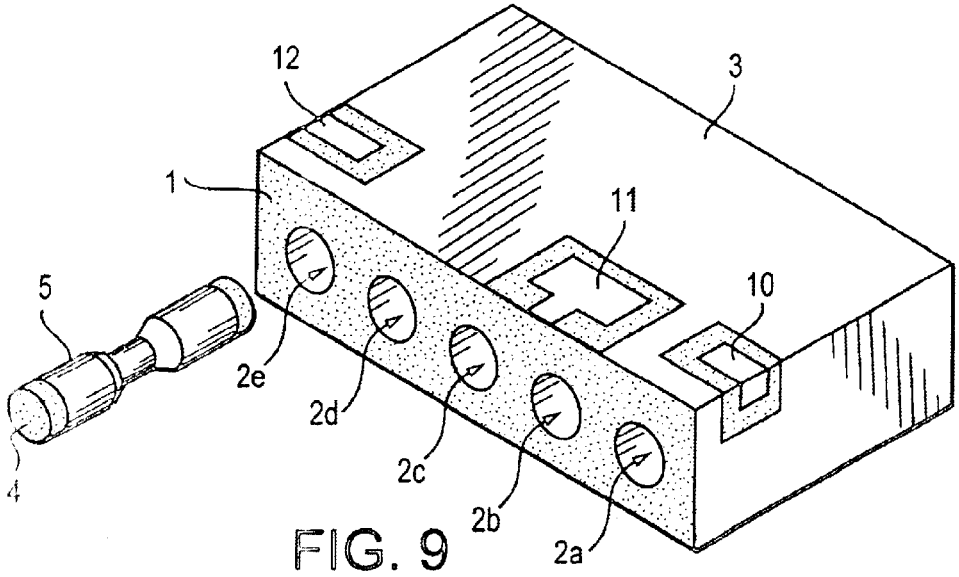
FIG. 9 is a perspective view of a duplexer according to a seventh embodiment of the present invention.

FIG. 9 is a perspective view of the duplexer. A substantially rectangular dielectric block 1 has through-holes 2*a* to 2*e* formed therein. An outer conductor 3 extends across the four outer surfaces of the dielectric block 1 other than the facing surfaces in which the through-holes 2*a* to 2*e* are opened.

In FIG. 9, a cylindrical shaft 4 formed of a dielectric element is shaped to have a greater diameter at the ends and to have a smaller diameter at the center. An inner conductor 5 having a thin-film, multi-layer electrode structure is formed on an outer surface of the cylindrical shaft 4. Although only one cylindrical dielectric element 4 is illustrated in FIG. 9, the thus constructed dielectric element 4 is inserted into each of the through-holes 2*a* to 2*e* in the dielectric block 1 and is secured thereto. The outer conductor 3 may have a thin-film, multi-layer electrode structure, or may be a single-layer electrode film. The inner conductors 5 may be formed as a multiple helical line unit.

Therefore, a coaxial resonator is formed between the inner conductor 5 and the outer conductor 3, and between the inner conductor 5 and a dielectric section of the dielectric block 1. The inner conductor 5 has a larger diameter at the open end portions, and a smaller diameter at an equivalent shorted end portion located at the center, so that these portions have different diameters and lengths. This generates a difference in resonant frequency between an odd mode and an even mode so that the extent of coupling therebetween can be controlled.

Formed on outer surfaces of the dielectric block 1 are input/output electrodes 10, 11 and 12 insulated from the outer conductor 3. The input/output electrodes 10 and 12 are capacitively coupled to the resonators formed in the through-holes 2*a* and 2*e*, respectively. Similarly, the input/output electrode 11 is capacitively coupled to the resonators formed in the through-holes 2*b* and 2*c*. A combination of the resonators formed in the through-holes 2*a* and 2*b*, respectively, is used herein as a transmission filter, while a combination of the resonators formed in the through-holes 2*c* to 2*e*, respectively, is used herein as a reception filter. In other words, the input/output electrodes 10, 11, and 12 are used as a transmission signal input terminal, an antenna terminal, and a reception signal output terminal, respectively.

As an alternative, instead of the example shown in FIG. 9 in which input/output electrodes are formed on outer surfaces of a dielectric block, probes may be inserted into the dielectric block for the purpose of an external connection.

The configuration of a communication device according to an eighth embodiment of the present invention is described with reference to FIG. 10.

Figure 10:
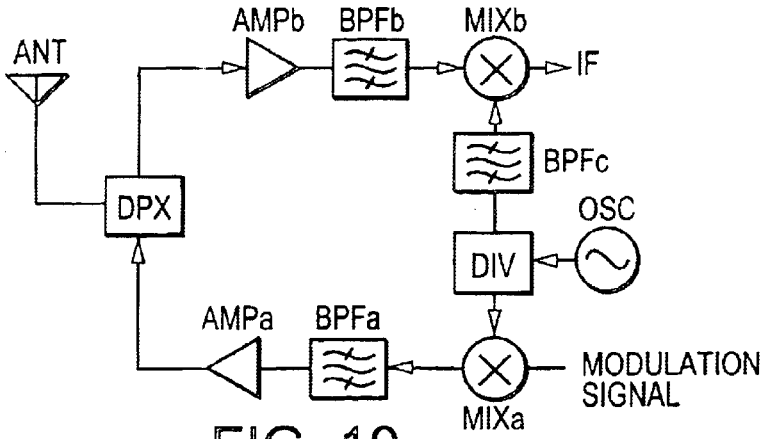
FIG. 10 is a block diagram of the structure of a communication device according to an eighth embodiment of the present invention.

In FIG. 10, an oscillation signal generated by an oscillator OSC is passed to a frequency divider (synthesizer) DIV. A frequency signal output from the frequency divider DIV is modulated with a modulation signal by a mixer MIXa, and is sent to a band-pass filter BPFa where the signal is transmitted only in the transmission frequency band. The resulting signal is amplified by an amplifier circuit AMPa, and is passed through a duplexer DPX followed by transmission from an antenna ANT. A reception signal from the duplexer DPX is amplified by an amplifier circuit AMPb. The signal output from the amplifier circuit AMPb is sent to a band-pass filter BPFb where the signal is transmitted only in the reception frequency band. The reception signal is then mixed with a frequency signal output from a band-pass filter BPFc by a mixer MIXb to output an intermediate frequency signal IF.

The duplexer DPX shown in FIG. 10 may be a duplexer having a structure shown in FIG. 9. The band-pass filters BPFa, BPFb, and BPFc may be filters each formed by a coaxial resonator having any of the structures shown in FIGS. 1 to 8. Therefore, an overall compact communication device with a reduced loss is achieved.

While a cylindrical dielectric element is used as the columnar element having an inner conductor formed thereon in the illustrated embodiments, the columnar element may have any shape, such as a polygon. The columnar element, whose permittivity is arbitrary, is used to hold the inner conductor on the outer surface thereof, and may be a conductor element made of metal, etc., or a magnetic element.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A coaxial resonator comprising:

an inner conductor formed on an outer surface of a columnar element;

a dielectric element having a hole formed therein, the columnar element being disposed in the hole;

an outer conductor formed on an outer surface of the dielectric element; and a non-conducting element disposed between the columnar element and the dielectric element, wherein the inner conductor has a multi-layer electrode structure in which conductor layers and dielectric layers are alternately laminated to form lines, each line comprising a dielectric layer and an adjacent conductor layer of the inner conductor, wherein a thickness of the conductor layers and a thickness of the dielectric layers are determined by phase constants of the lines, the phase constants of the lines being substantially equal, and wherein the non-conducting element is air.

2. The coaxial resonator according to claim 1, wherein the inner conductor comprises a plurality of helical lines.

3. The coaxial resonator according to claim 1 or 2, wherein the phase constants of the lines for the conductor layers in the inner conductor are substantially equal to phase constants of lines for the conductor layers in the outer conductor.

4. A filter comprising:

a plurality of coaxial resonators, each coaxial resonator comprising:

an inner conductor formed on an outer surface of a columnar element, wherein the inner conductor has a multi-layer electrode structure in which conductor layers and dielectric layers are alternately laminated to form lines, each line comprising a dielectric layer and an adjacent conductor layer of the inner conductor;

a dielectric element having a hole formed therein, the columnar element being disposed in the hole;

an outer conductor formed on an outer surface of the dielectric element; and a non-conducting element disposed between the columnar element and the dielectric element, wherein a thickness of the conductor layers and a thickness of the dielectric layers are determined by phase constants of the lines, the phase constants of the lines being substantially equal, and wherein the non-conducting element is air; and an input/output device coupled to a predetermined coaxial resonator of the plurality of coaxial resonators.

5. A duplexer comprising:

a transmission filter disposed between a transmission signal input port and a transmission/reception signal input/output port; and a reception filter disposed between the transmission/reception signal input/output port and a reception signal output port, wherein at least one of the transmission filter and the reception filter includes a plurality of coaxial resonators, each coaxial resonator comprising:

an inner conductor formed on an outer surface of a columnar element, wherein the inner conductor has a multi-layer electrode structure in which conductor layers and dielectric layers are alternately laminated to form lines, each line comprising a dielectric layer and an adjacent conductor layer of the inner conductor;

a dielectric element having a hole formed therein, the columnar element being disposed in the hole;

an outer conductor formed on an outer surface of the dielectric element; and a non-conducting element disposed between the columnar element and the dielectric element, wherein a thickness of the conductor layers and a thickness of the dielectric layers are determined by phase constants of the lines, the phase constants of the lines being substantially equal, and wherein the non-conducting element is air; and an input/output device coupled to a predetermined coaxial resonator of the plurality of coaxial resonators, the input/output device being coupled to a corresponding one of the ports.

6. A communication device comprising:

a high-frequency circuit comprising a transmission circuit and a reception circuit; and a duplexer comprising:

a transmission filter disposed between a transmission signal input port and a transmission/reception signal input/output port; and a reception filter disposed between the transmission/reception signal input/output port and a reception signal output port, wherein at least one of the transmission filter and the reception filter includes a plurality of coaxial resonators, each coaxial resonator comprising:

an inner conductor formed on an outer surface of a columnar element, wherein the inner conductor has a multi-layer electrode structure in which conductor layers and dielectric layers are alternately laminated to form lines, each line comprising a dielectric layer and an adjacent conductor layer of the inner conductor;

a dielectric element having a hole formed therein, the columnar element being disposed in the hole;

an outer conductor formed on an outer surface of the dielectric element; and a non-conducting element disposed between the columnar element and the dielectric element, wherein a thickness of the conductor layers and a thickness of the dielectric layers are determined by phase constants of the lines, the phase constants of the lines being substantially equal, and wherein the non-conducting element is air; and an input/output device coupled to a predetermined coaxial resonator of the plurality of coaxial resonators and coupled to a corresponding one of the ports.

7. A communication device comprising:

a high-frequency circuit comprising at least one of a transmission circuit and a reception circuit, the high-frequency circuit comprising:

a plurality of coaxial resonators, each coaxial resonator comprising:

an inner conductor formed on an outer surface of a columnar element, wherein the inner conductor has a multi-layer electrode structure in which conductor layers and dielectric layers are alternately laminated to form lines, each line comprising a dielectric layer and an adjacent conductor layer of the inner conductor;

a dielectric element having a hole formed therein, the columnar element being disposed in the hole;

an outer conductor formed on an outer surface of the dielectric element; and a non-conducting element disposed between the columnar element and the dielectric element, wherein a thickness of the conductor layers and a thickness of the dielectric layers are determined by phase constants of the lines, the phase constants of the lines being substantially equal, and wherein the non-conducting element is air; and an input,/output device coupled to a predetermined coaxial resonator of the plurality of coaxial resonators.

8. A coaxial resonator comprising:

an inner conductor formed on an outer surface of a columnar element;

a dielectric element having a hole formed therein, the columnar element being disposed in the hole;

an outer conductor formed on an outer surface of the dielectric element; and a non-conducting element disposed between the columnar element and the dielectric element, wherein the inner conductor has a multi-layer electrode structure in which conductor layers and dielectric layers are alternately laminated to form lines, each line comprising a dielectric layer and an adjacent conductor layer of the inner conductor, wherein a thickness of the conductor layers and a thickness of the dielectric layers are determined by phase constants of the lines, the phase constants of the lines being substantially equal, and wherein the inner conductor is formed separate from the dielectric element and inserted into the hole of the dielectric element.

* * * * *